US005459946A

United States Patent [19]

Rayow

[11] Patent Number: 5,459,946

[45] Date of Patent: Oct. 24, 1995

[54] TAP DANCE SHOE AND METHOD FOR ATTACHING TAP TO DANCE SHOE

[76] Inventor: Robert Rayow, 326 S. Smith Rd., LaGrangeville, N.Y. 12540

[21] Appl. No.: 276,263

[22] Filed: Jul. 18, 1994

[51] Int. Cl.[6] ..... A43B 5/12

[52] U.S. Cl. ..... 36/8.3; 36/134; 36/113

[58] Field of Search ..... 36/8.3, 113, 139, 36/1, 134, 67 D

[56] References Cited

U.S. PATENT DOCUMENTS

| | | | |
|---|---|---|---|
| 1,797,668 | 3/1931 | Morisse | 36/134 X |
| 2,023,346 | 12/1935 | Temple | 36/1 X |
| 2,109,712 | 3/1938 | Schmalz | 36/43 X |
| 2,192,150 | 2/1940 | Pierce et al. | 36/134 |
| 3,007,260 | 11/1961 | Stone | 36/8.3 |
| 4,875,300 | 10/1989 | Kazz | 36/134 |
| 5,363,526 | 11/1994 | Okajima | 36/131 X |

*Primary Examiner*—Steven N. Meyers
*Assistant Examiner*—BethAnne C. Cicconi
*Attorney, Agent, or Firm*—Ostrolenk, Faber, Gerb & Soffen

[57] ABSTRACT

A tap dance shoe and method for attaching a tap to a dance shoe includes securing a single T-nut in a fiber board and then installing the combined T-nut and fiber board assembly on the sole of the shoe. The shoe may have a preformed hole for receiving the T-nut. The fiber board is attached to the sole by nailing, for example. The fiber board has a fixture formed thereon for positioning a tap relative to the sole of the shoe. The tap has a hole for aligning with the T-nut and also an engaging member for accommodating the fixture formed on the fiber board. Once the fiber board is secured to the sole, the tap is located on the fiber board by mating the fixture with the engaging member of the tap. The tap is secured to the shoe and fiber board by inserting a single screw into the single T-nut and tightening. An adhesive resin and a spring can be applied to a threaded portion of the screw to securely hold the tap on the sole of the shoe.

30 Claims, 4 Drawing Sheets

TAP DANCE SHOE AND METHOD FOR ATTACHING TAP TO DANCE SHOE

BACKGROUND OF THE INVENTION

The present invention relates to a tap dance shoe and a method for applying a tap to a dance shoe and more particularly, a method for applying a metal tap and attachment fixture to a sole of a dance shoe.

A shoe used for tap dancing has a tap attached to the front of the sole of the shoe and a tap attached to the rear of the shoe where a heel is located. The tap should be firmly attached in a way that enables the shoe to produce a good quality tap sound.

One technique for applying the taps to the sole is to nail the tap to the sole or screw the tap directly onto the sole or heel. Typically, the tap is fastened by at least three screws, one at the tip (or rear) and two spaced from the tip (or rear) where the tap widens.

Because the screw or nails are likely to work their way out of the sole through normal use of the tap, it is known to apply a thin piece of fiber board to the surface of the sole with numerous nails. The fiber board is thin enough so that it does not effectively increase the thickness of the sole. Then the tap is attached to the sole by nailing or screwing the tap to the sole of the shoe through the fiber board. The fiber board is held by the screws or nails to hold the tap securely. But securing the tap still usually requires attachment in at least three locations and the screws or nails still can work their way loose from the sole of the shoe because of the lever action of the tap against the sole of the shoe.

A tap may also be applied by forming threaded holes in the sole, installing an internally threaded, generally rivet-shaped or T-shaped nut in each of the threaded holes formed in the sole and then applying the tap to the sole. The T-nut includes a flange having a plurality of prongs on a surface of the flange facing the sole of the shoe. The prongs are nailed to the sole of the shoe to secure the T-nut to the shoe. Then the tap is secured to the sole by inserting and tightening a screw through a hole in the tap and into the T-nut embedded in the hole in the sole.

This method presents problems as there are manufacturing tolerances in forming the holes and in forming the taps which sometimes result in misalignment of holes. Also, the lever action of the tap often causes the prongs of the T-nut nailed to the sole to be pulled out allowing the fiber board and the tap to separate from the sole of the shoe. Further, since three bolts are required, the installation time may be as much as 15 minutes.

SUMMARY OF THE INVENTION

It is an object of the present invention to provide tap dance shoe and a method of applying a tap to a dance shoe that is quicker, easier, and produces a better tap sound than prior art shoes.

It is also an object of the present invention to provide a method of applying a tap to a dance shoe that allows the tap to be quickly and accurately located on the sole of the shoe thereby overcoming the prior art difficulties with misalignment caused by manufacturing tolerances.

It is a further object of the present invention to provide a method of applying a tap to a dance shoe that prevents the tap from working itself free from the sole of the shoe.

The method of the present invention includes securing a single T-nut to a piece of fiber board and then attaching the combined T-nut and fiber board assembly to the sole. The T-nut preferably has a flange and a plurality of prongs formed on a surface of the flange that faces the fiber board and faces away from the sole of the shoe. The prongs are inserted through a bottom surface of the fiber board and bent over a top surface of the fiber board so that the prongs are flush with the top surface of the fiber board. After the T-nut is secured to the fiber board, the combined T-nut and fiber board assembly are mounted on the sole of the shoe. A preformed hole may be provided in the sole for receiving a shank of the T-nut. The combined fiber board and T-nut assembly is attached to the sole in the usual way, e.g. nailing. The T-nut is typically disposed in the middle of the fiber board.

A front tap is mounted on a front portion of the sole of the shoe and a rear tap is mounted on a rear portion of the sole of the shoe. A front fiber board and a rear fiber board are mounted between the sole of the shoe and the taps.

A fixture is formed on a front end of the front fiber board and a rear end of the rear fiber board. Each of the front tap and the rear tap has a preformed fixture engaging member for accommodating a fixture. When each tap is applied on the sole, the fixture engaging member formed in the tap is located and held on the fixture while the tap is secured to the sole by insertion and tightening of a single screw in the single T-nut. Thus, the tap is oriented by locating the fixture engaging member on the fixture formed on the fiber board. The fixture on the fiber board may be a protrusion extending outwardly from the fiber board toward the tap. The fixture engaging member may be a recess formed in the tap so that the protrusion is received in the recess formed in the tap. Alternatively, the tap may have a protrusion that extends towards the fiber board and the fiber board may have a hole or recess which receives the tap protrusion. If the tap is to be formed by molding, the latter technique for forming the fixture is preferred.

To hold the single screw securely in the T-nut and the sole, an adhesive resin or the like, e.g. the product known by the trademark "LOCTITE" is applied on the screw and holds it securely in the nut which is fixedly mounted in the sole.

To further prevent the screw from loosening and eventually working free, a spring may be provided on the threaded portion of the screw. The spring is compressed when the screw is tightened and locks the screw against rotation to hold the screw securely in the T-nut.

This design with a single screw for attaching each tap is beneficial for a number of reasons. First, it allows the taps to be rapidly and inexpensively installed. Applying a normal tap with three screws takes about 15 minutes. Application of the tap with a single screw requires less than 5 minutes.

In addition, the single screw arrangement allows better sound quality with the tap as there are fewer dead areas. Dead areas occur where there is secure attachment of the edge of the tap to the shoe sole. Further, the single attachment point allows the tap to move up and down relative to the sole of the shoe in any direction to produce a desired castinet-like sound. Also, the sound of the tap can be quickly and easily adjusted by tightening and loosening the single screw,.

The spring and adhesive are important because a single screw is likely to work itself free. To prevent against loosening between the screw and T-nut, the LOCTITE holds the screw securely in the T-nut. In addition, a spring may be located on the threaded portion of the screw to lock the screw against rotation, thereby preventing the screw from backing out of the hole in the sole. Thus, cooperation between the screw, the adhesive and/or the spring prevents the screw from working itself free.

Also important is that the T-nut is supported on the fiber board, which permanently fixes the T-nut so that the T-nut cannot work its way out. In addition, the T-nut has a plurality of prongs that are located between the fiber board and the tap which prevents the fiber board, the T-nut and the tap from working free from the sole.

The size of the fiber board piece is at least as large as and at least the same profile or a wider profile than the tap for sound producing reasons, as the tap sounds better when it directly contacts the fiber board rather than when it directly contacts the sole.

While the single attachment point of the present invention allows the tap to move up and down relative to the sole of the shoe in any direction, the fixture and cooperating fixture engaging member aligns the tap relative to the sole of the shoe and the fiber board so that the profile of the fiber board and sole will substantially match the profile of the tap to produce a high quality sound. This also allows the tap to be quickly and easily located on the sole, thereby decreasing the time required for attaching the tap.

Other features and advantages of the present invention will become apparent from the following description of the invention which refers to the accompanying drawings.

DETAILED DESCRIPTION OF THE INVENTION

Figure 1:
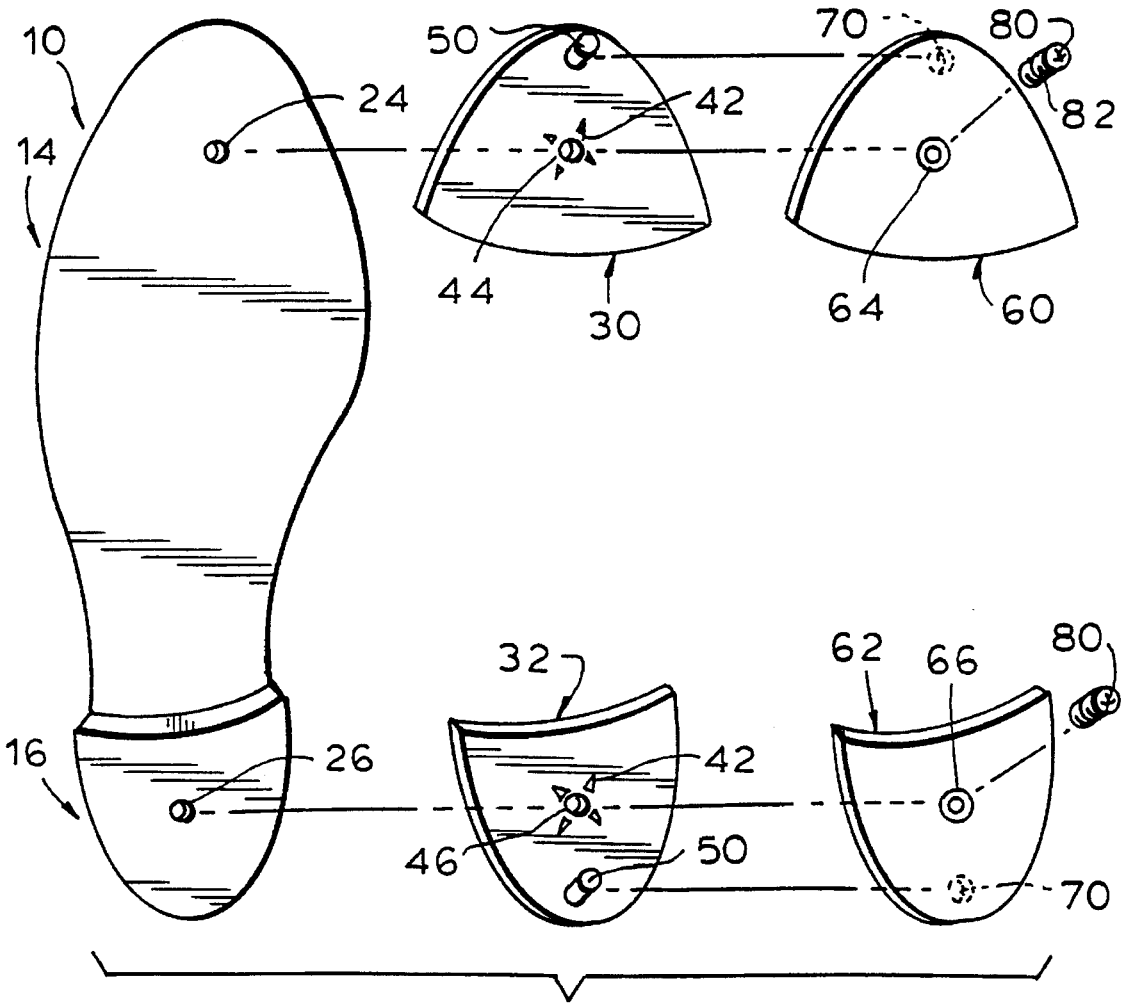
FIG. 1 is an exploded schematic view of a first embodiment of the invention including a tap shoe, fiber boards and taps to be applied to the shoe.
Figure 4:
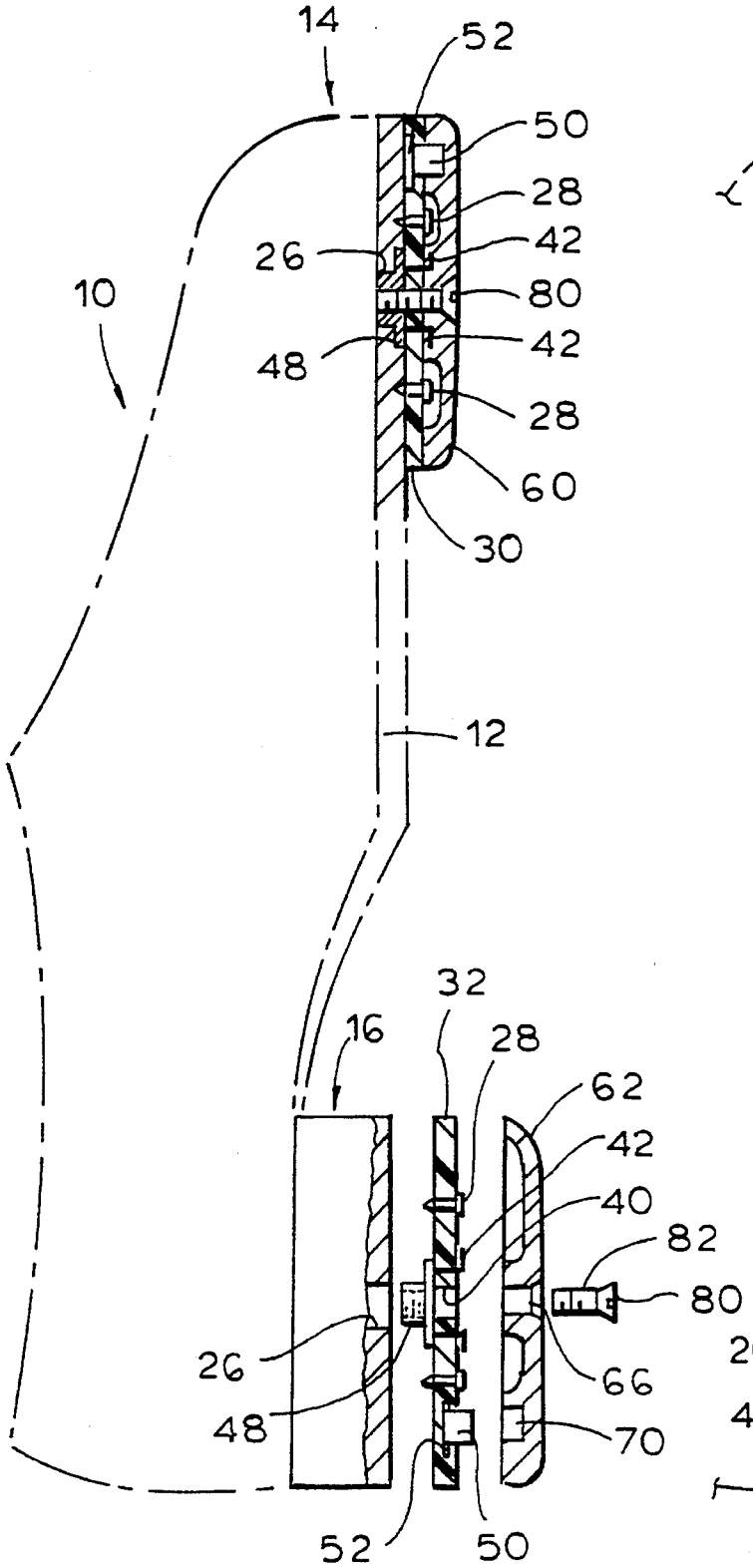
FIG. 4 is a section view of the embodiment shown in FIG. 1.

Referring to the Figures, a first embodiment of a tap dance shoe 10, shown in FIGS. 1 and 4, has a sole 12 which includes a front portion 14 and a heel portion 16 located at a rear of the shoe. Preformed holes 24, 26 are formed in the front portion 14 and heel portion 16, respectively to receive a nut described in the following paragraphs.

A front fiber board 30 and a rear fiber board 32 are provided for securing taps to the sole 12 of the shoe 10. It should be noted that the thickness of each of the fiber boards shown in the drawings is exaggerated to show the construction of the present invention. The actual thickness of each fiber board is substantially less than that shown in the figures.

Each of the front fiber board 30 and the rear fiber board 32 have a substantially T-shaped nut 40 (hereinafter referred to as a T-nut) attached to fiber boards 30, 32. The T-nut 40 has a flange 41 having a plurality of prongs 42 formed on an upper surface of the flange 41 for attaching the T-nut 40 to the fiber boards 30, 32. Once attached to the fiber boards 30, 32, the prongs 42 prevent the T-nut from rotating relative to the fiber boards 30, 32 and the sole 12 of the shoe 10. The T-nut 40 may preferably have an internal threaded portion 48 for threadedly engaging with a screw described in the following paragraphs. Also, if the preformed holes 24, 26 are threaded, the T-nut 40 may preferably have an external thread for engaging the threaded holes 24, 26 to secure the T-nut 40 to the sole 12.

In addition, each of the front fiber board 30 and rear fiber board 32 have a fixture 50 located near a frontmost and rearmost portion of each fiber board. In the embodiment shown in FIG. 1, the fixture 50 is formed as a projection extending from the surface of the fiber board away from the sole 12 of the shoe 10. The projection 50 is shaped so as to engage a recess formed in a tap to be applied to the shoe as will be explained in the following paragraphs.

The front fiber board 30 and the rear fiber board 32 are formed by cutting a fiber board to have a shape that substantially corresponds to a shape of a tap to be applied to the shoe 10. The size of each of the fiber boards 30, 32 is at least as large as and at least the same profile or wider than the tap for sound producing reasons, because the tap sounds better when the tap directly contacts the fiber boards 30, 32 rather than when the tap directly contacts the sole.

Holes 44, 46 are formed in the fiber boards 30, 32, respectively, so that the holes 44, 46 align with the preformed threaded holes 24, 26 in the sole 12 of the shoe 10. Then a T-nut 40 is fixedly mounted to the fiber boards so that the internal threaded portion of the T-nut is aligned with each of holes 44, 46. The T-nut 40 is attached to the fiber boards 30, 32 by inserting the prongs 42 into the fiber boards 30, 32 and bending the prongs 42 over the top surface of the fiber boards 30, 32 so that the prongs 42 are flush with the top surface of the fiber board 30, 32. The advantage of the shoe 10 having preformed holes 24, 26 is that the combined T-nut and fiber board assembly can be quickly and accurately positioned and attached on the sole 12 of the shoe 10. This facilitates location and attachment of the taps to the fiber boards 30, 32 and the sole 12 of the shoe 10 as described in the following paragraphs. The combined T-nut and fiber board assembly is attached to the sole 12 in a conventional manner, such as driving nails 28 through the fiber boards 30, 32 and into the sole 12.

As seen in FIG. 4, the flange 41 of each T-nut 40 is located between the sole 12 and the fiber boards 30, 32 and the prongs 42 are located between the fiber boards 30, 32 and the taps 60, 62. Once the fiber boards 30, 32 are secured to the sole 12 of the shoe 10 by nails 28, the flange 41 of each T-nut 40 is sandwiched between the sole 12 and the fiber boards 30, 32. Because the nails 28 hold the fiber boards 30, 32 securely on the sole 12 with the T-nut 40 sandwiched therebetween, the T-nut 40 cannot work itself free from the shoe 10 during use. Thus, the prongs 42 are not nailed to the sole 12 of the shoe 10 as in prior art devices discussed above and therefore, the T-nut 40 will not be separated from the sole 12 of the shoe 10. Also, the T-nuts 40 fit within the holes 24, 26 so that the T-nuts 40 are flush with the surface of the sole 12 and thus, do not increase the thickness of the combined T-nut and fiber board assemblies.

The fixtures 50 are also fixedly secured in each of the fiber boards 30, 32 at the frontmost and rearmost portions thereof. Each of the fixtures 50 may preferably include a flange 52 for retaining each of the fixtures 50 in the fiber boards 30,

32.

A front tap 60 and a rear tap 62 are also provided and are mounted on the front portion 14 and heel portion 16 of the sole 12. The taps 60, 62 each have a hole 64, 66, respectively, formed in a central portion thereof for aligning with the holes 44, 46 formed in the fiber boards 30, 32 and the holes 24, 26 formed in the sole 12 of the shoe 10.

Each of the taps 60, 62 also has a fixture engaging member 70 for engaging the fixtures 50 fixedly secured on the fiber boards 30, 32. In the embodiment shown in FIGS. 1 and 4, the fixture engaging members 70 are formed as recesses shaped to engage with the projections 50 on the fiber boards 30, 32.

The projections 50 on the fiber boards 30, 32 accurately position each of the taps 60, 62 on each of the fiber boards 30, 32. More importantly, by accurately positioning the taps 60, 62 on the fiber boards 30, 32, the taps 60, 62 are accurately positioned on the sole 12 of the shoe 10 by locating the recesses 70 on the fixtures 50 formed on the fiber boards 30, 32. In addition, because the fiber boards 30, 32 are already accurately positioned on the sole 12 of the shoe 10, the taps 60, 62 can be quickly and easily positioned on the sole 12 of the shoe 10 by engaging the fixture engaging members 70 with the fixtures 50 on the fiber boards 30, 32.

Each of the taps 60, 62 is secured to the fiber boards 30, 32 and the sole 12 of the shoe 10 by a single screw 80. The single screw 80 is threaded to engage with the threaded portion of the T-nut 40. This single screw arrangement allows better sound quality with the tap as there are fewer dead areas. Also, the required installation time is greatly reduced because only one screw must be inserted and tightened to secure a tap to the sole of the shoe.

The single screw 80 is the only attachment point for each tap 60, 62. This configuration allows each of the taps 60, 62 to pivot up and down relative to the sole 12 in any direction to produce a desired castinet sound. The sound produced by the taps 60, 62 can be easily customized by tightening or loosening the screw 80. The fixture 50 and fixture engaging member 70 position each tap on the sole 12 of the shoe 14 but do not constitute a point of attachment.

The method of attaching the components shown in FIGS. 1 and 4 is as follows. The T-nuts 40 are fixedly secured in each of the fiber boards 30, 32 as described above making sure that the prongs 42 are positioned between the fiber boards 30, 32 and the taps 60, 62 and that the peripheral flange 41 is positioned between each of the fiber boards 30, 32 and the sole 12 of the shoe 10. Then, the combined T-nut and fiber board assemblies are located on the sole 12 of the shoe 10 by engaging the T-nuts 40 in the holes 24, 26 formed in the sole 12. If the T-nuts 40 have an external thread and the holes 24, 26 are internally threaded, the T-nuts 40 can be threadedly engaged with the holes 14, 16. The fiber boards 30, 32 are then secured to the sole 12 of the shoe 10 by a conventional method such as driving nails 28 through the fiber boards 30, 32 and into the sole 12.

Each of the taps 60, 62 is located on the fiber boards 30, 32 by positioning and engaging the fixture engaging members 70 on the fixtures 50 formed on the fiber boards 30, 32. A threaded screw 80 is then inserted into each of the aligned holes 24, 44, 64 and 26, 46, 66 formed in the sole 12, fiber boards 30, 32 and taps 60, 62, thereby threadedly engaging with the internal threaded portions of each T-nut 40. Each screw 80 is then tightened to fixedly secure the taps 60, 62 to the fiber boards 30, 32 and the sole 12 of the shoe 10. As discussed above, the prongs 42 prevent the T-nuts 40 from rotating relative to the fiber boards 30, 32 and the sole 12 of the shoe when the screw 80 is inserted into and tightened in the T-nuts 40.

Preferably, a threaded portion of each screw 80 is coated with an adhesive resin or the like to hold the screw securely in the T-nut 40 and on the sole 12. The adhesive resin will prevent the screw 80 from working itself free from the T-nut 40.

Also, each screw 80 may have a spring 82 located on a threaded portion of the screw 80. The spring 82 locks the screw 80 against rotation thereby preventing the screw 80 from rotating and working itself free from the shoe 10 during a performance.

FIG. 4 shows the completed assembly resulting from the above described method. As seen in FIG. 4, the prongs 42 are secured between the fiber boards 30, 32 and the taps 60, 62 and the flange 41 of the T-nut 40 is held between the sole 12 of the shoe 10 and the fiber boards 30, 32. Also, the recesses 70 formed in the taps 60, 62 are engaged with the projections 50 mounted on the fiber boards 30, 32. The screws 80 are countersunk to a sufficient depth in the taps 60, 62 so that the screw 80 can be backed out according to the preferences of a dancer and still remain below a striking surface of the taps 60, 62 to prevent the screw 80 from gouging the dance floor or affecting the sound quality produced by the taps 60, 62.

Figure 2:
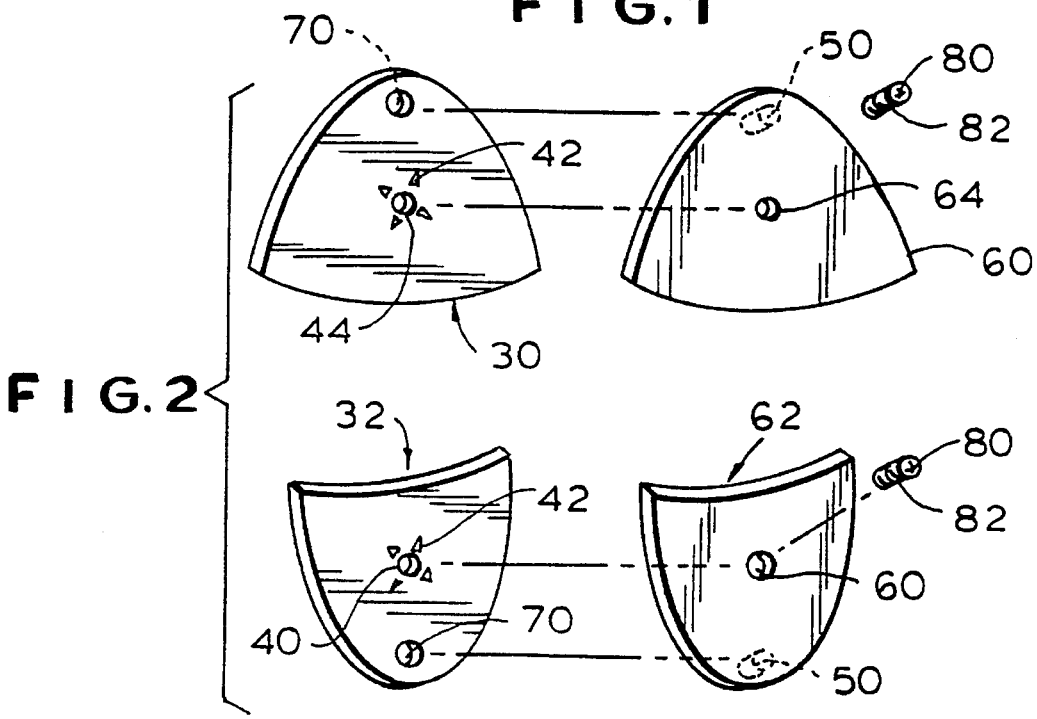
FIG. 2 is an exploded schematic view of a second embodiment of the invention including fiber boards and taps to be applied to a dance shoe.
Figure 7:
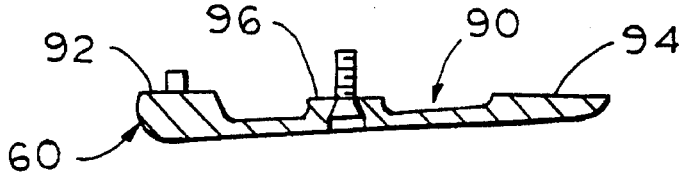
FIG. 7 is a partial sectional view of FIG. 5.
Figure 5:
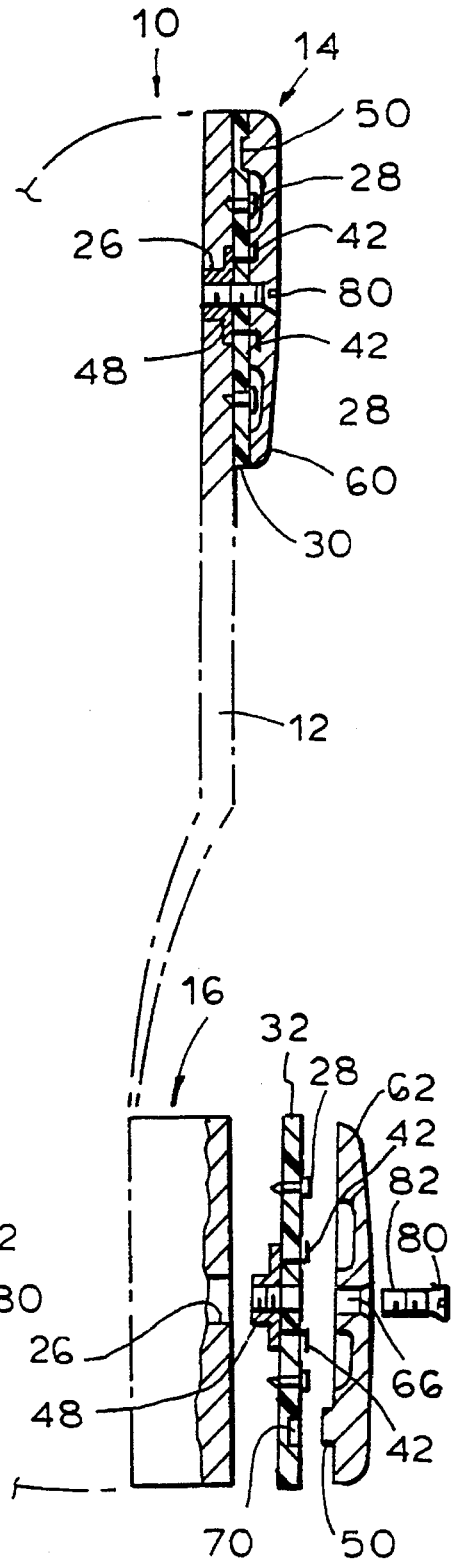
FIG. 5 is a section view of the embodiment shown in FIG. 2.

A second embodiment of the invention is shown in FIGS. 2, 5 and 7, where like reference numerals indicate like elements. The second embodiment differs from the first embodiment in that the fixtures 50 and fixture engaging members 70 are formed differently. Specifically, fixtures 50 in the form of projections are formed on each of the taps 60, 62 instead of on the fiber boards 30, 32 as in the first embodiment. Also, the fixture engaging members 70 in the form of recesses are formed in or through the fiber boards 30, 32 instead of in the taps 60, 62 as in the first embodiment. If the taps 60, 62 are to be formed by molding, the technique for forming the fixtures 50 and fixture engaging members 70 described in the second embodiment is preferred. For example, as seen in FIG. 5, the protrusions 50 formed on the taps 60, 62 can be made as a continuous portion of the taps 60, 62 without requiring an additional step of mounting the protrusions 50 on the taps.

This embodiment provides an advantageous feature in that if the screw 80 should work free during a performance and a tap is thrown off of the shoe 10, the dancer will be able to continue dancing because the fiber boards 30, 32 remain affixed to the shoe 10 and form a smooth, continuous surface. Thus, although the tap may be thrown off of the shoe, the surface of the exposed fiber board 30, 32 does not have any projections that would destroy a dance floor or prevent a dancer from continuing.

As seen in FIGS. 5 and 7, the taps 60, 62 are shaped to form a sound producing cavity 90 when mounted on the sole 12 of the shoe 10. The sound producing cavity 90 is configured to produce an excellent sounding tone when attached according to the method described above. The sound producing cavity 90 is surrounded by front and rear circumferential edge portions 92, 94, respectively and a central member 96 of the tap 80. The front and rear circumferential edge portions 92, 94 form a continous edge that lies flush against the fiber boards 30, 32 and surround the cavity 90. The front end portion 92 has a fixture 50 integrally formed thereon.

The central member 96 which receives the screw 90 may be formed to be lower than the front and rear end portions 92, 94 so that the central member 92 does not contact the fiber boards 30, 32 when the taps 60, 62 are secured to the fiber boards 30, 32. This allows the taps 60, 62 to contact the fiber boards 30, 32 at only the front and rear circumferential edge portions 92, 94 for sound producing reasons.

If an alternative sound is desired, washers (not shown) may be located on the screw 80 to rest on the central member 96 so that the height of the central member 96 is equal to that of the front and rear end portions 92, 94. Thus, each tap 60, 62 would contact the fiber boards 30, 32 at the circumferential edge portions 92, 94 and the central member 96 to vary the sound produced by the taps 60, 62. If another alternative sound is desired, the thickness of the washer or washers can be such that the central member 96 is higher than the circumferential edge portions 92, 94. In such an arrangement, the taps 60, 62 would contact the fiber boards 30, 32 only at each central member 96 and would not contact the fiber boards 30, 32 at the circumferential edge portions 92, 94.

Figure 3:
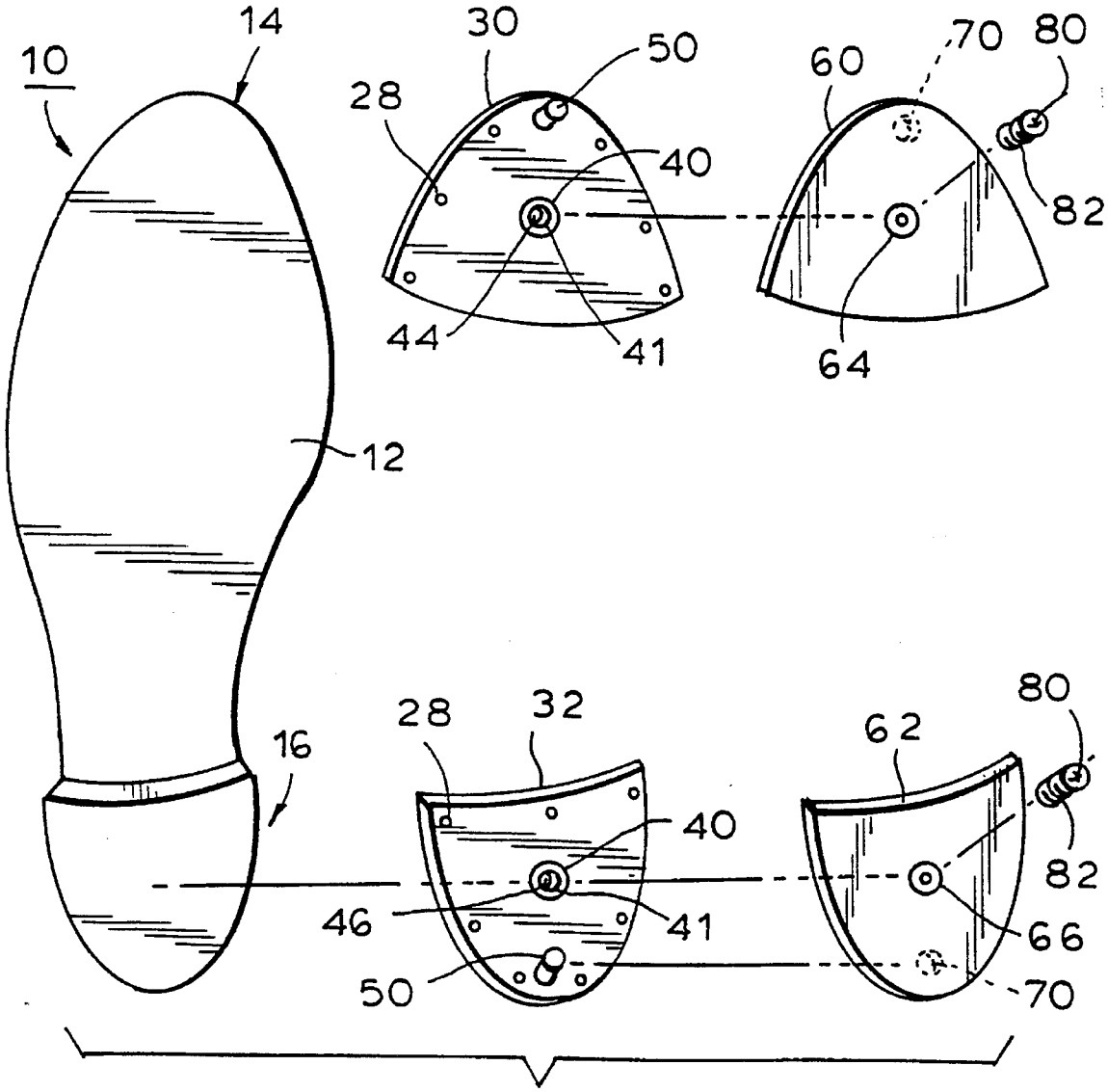
FIG. 3 is an exploded schematic view of a third embodiment of the invention including fiber boards and taps to be applied to the dance shoe.
Figure 6:
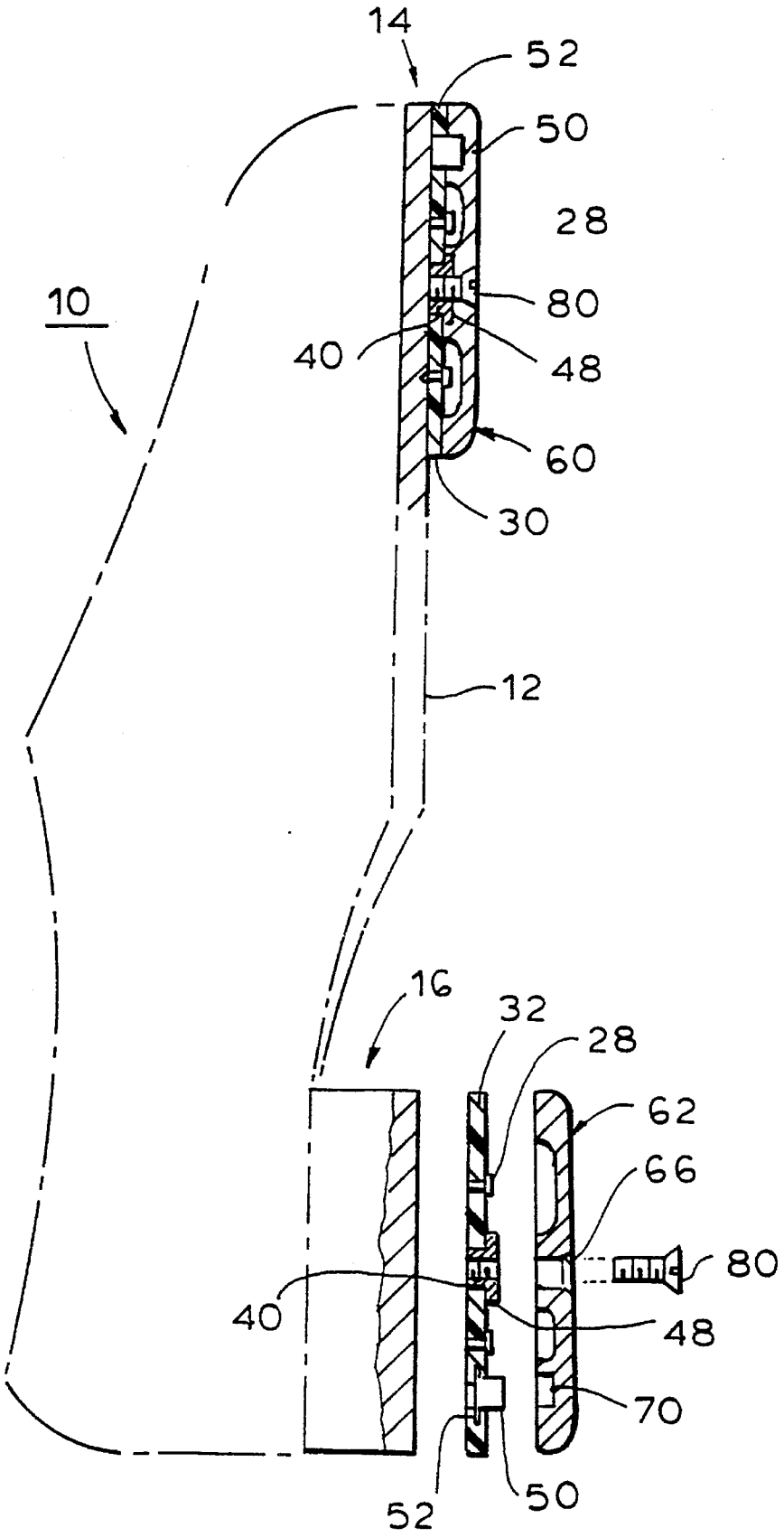
FIG. 6 is a section view of the embodiment shown in FIG. 3.

A third embodiment is shown in FIGS. 3 and 6, where like reference numerals indicate like elements. As seen in FIG. 3, the sole 12 of the shoe 10 does not have preformed threaded holes 24, 26 formed in the front portion 14 and the heel portion 16 as in the first embodiment.

If shoes having preformed holes for accommodating a T-nut 40 are unavailable, the combined T-nut and fiber board assemblies can be positioned on the unaltered sole 12 by matching the fiber board pattern with a shape of each of the front portion 14 and rear portion 16 of the shoe 10. Unlike the first embodiment, the prongs 42 of the T-nut 40 are located on a surface facing the sole 12 of the shoe 10 and are attached to the fiber boards 30, 32 so that the prongs 42 are located between the fiber boards 30, 32 and sole. Also, the T-nuts 40 are received in the holes 44, 46 in the fiber boards 30, 32 so that the flanges 41 are located in the fiber boards 30, 32 and the taps. The T-nut and fiber board assemblies are attached to the sole 12 with nails 28.

As seen in FIG. 6, the thin peripheral flange 41 of the T-nut 40 fits between the fiber boards 30, 32 and the taps 60, 62. In this embodiment, the flange 41 is thin enough to not significantly increase the thickness of the combined T-nut and fiber board assembly but thick enough to hold the T-nut 40 securely on the sole 12.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of attaching a tap to a dance shoe having a sole, the method comprising the steps of:

providing a fiber board;

mounting a nut in the fiber board;

attaching the fiber board to the sole of the shoe;

providing a tap;

locating the tap on the fiber board; and attaching the tap to the fiber board.

2. The method of claim 1, wherein the shoe has at least one hole formed in the sole, the method step of attaching the fiber board to the sole of the shoe including the step of inserting the nut in the at least one hole formed in the sole.

3. The method of claim 1, wherein the fiber board has a projection formed thereon and the tap has a recess formed therein, the step of locating the tap on the fiber board further comprises the step of locating the recess of the tap on the projection of the fiber board.

4. The method of claim 1, wherein the fiber board has a recess formed therein and the tap has a projection formed thereon, the step of locating the tap on the fiber board further comprises the step of locating the projection of the tap in the recess formed in the fiber board.

5. The method of claim 1, wherein the tap has an opening formed therein and the step of attaching the tap to the fiber board includes the step of inserting a screw through the opening in the tap and into the nut.

6. The method of claim 5, further comprising the step of applying an adhesive resin to the screw before inserting the screw into the nut.

7. The method of claim 5, further comprising the step of mounting a spring on the screw before inserting the screw into the nut.

8. The method of claim 1, wherein the nut comprises a substantially T-shaped nut.

9. The method of claim 1, wherein only one nut and one screw are used to attach the tap to the fiber board and the sole of the shoe.

10. The method of claim 1, wherein the nut has a flange and the method further comprises the step of positioning the flange between the sole of the shoe and the fiber board before attaching the fiber board to the sole of the shoe.

11. The method of claim 10, wherein the flange has a plurality of prongs formed on a surface of the flange facing away from the sole of the shoe, the method step of mounting the nut in the fiber board including the steps of inserting the prongs through the fiber board and bending the prongs so that the prongs are flush with a surface of the fiber board.

12. A method of attaching a tap to a dance shoe having a sole, the method comprising the steps of:

providing a fiber board having a fixture formed thereon;

mounting a nut in the fiber board;

attaching the fiber board to the sole of the shoe;

providing a tap;

locating the tap on the fixture of the fiber board attached to the shoe; and attaching the tap to the fiber board.

13. The method of claim 12, wherein the shoe has at least one hole formed in the sole, the step of attaching the fiber board to the sole including the step of inserting the nut in the at least one hole formed in the sole of the shoe.

14. The method of claim 12, wherein the fixture comprises a projection and the tap has a recess formed therein for receiving the projection.

15. The method of claim 12, wherein the fixture comprises a recess and the tap has a projection formed thereon for engaging the recess.

16. The method of claim 12, wherein the tap has an opening formed therein and the step of attaching the tap to the fiber board includes the step of inserting a screw through the opening in the tap and into the nut.

17. The method of claim 16, further comprising the step of applying an adhesive resin to the screw before inserting the screw into the nut.

18. The method of claim 16, further comprising the step of mounting a spring on the screw before inserting the screw into the nut.

19. The method of claim 12, wherein the nut comprises a substantially T-shaped nut.

20. The method of claim 12, wherein only one nut and one screw are used to attach the tap to the fiber board and the sole of the shoe.

21. The method of claim 12, wherein the nut has a flange and the method further comprises the step of positioning the flange between the sole of the shoe and the fiber board before attaching the fiber board to the sole of the shoe.

22. The method of claim 12, wherein the flange has a plurality of prongs located on a surface of the flange that faces away from the sole of the shoe, the method step of mounting the nut in the fiber board includes the steps of inserting the prongs through the fiber board and bending the prongs so that the prongs are flush with a surface of the fiber board.

23. A tap dance shoe comprising:

a) a sole having a front portion and a rear portion;

b) a front fiber board attached to the front portion and including
a hole;
a nut mounted in the hole formed in the front fiber board;
a front fixture;

c) a rear fiber board attached to the rear portion and including
a hole;
a nut mounted in the hole formed in the rear fiber board;
a rear fixture;

d) a front tap attached to the front portion and including
a hole aligned with the hole formed in the front fiber board;
a front engaging member for engaging the front fixture;

e) a rear tap attached to the rear portion and including
a hole aligned with the hole formed in the rear fiber board;
a rear engaging member for engaging the rear fixture;

f) a front screw engaged in the nut mounted in the front fiber board and the hole formed in the front tap; and g) a rear screw engaged in the nut mounted in the rear fiber board and the hole formed in the rear tap.

24. The tap dance shoe of claim 23, wherein the front and rear fixtures each comprise a projection and the front and rear engaging members each comprise a recess for accommodating the projection.

25. The tap dance shoe of claim 23, wherein the front and rear fixtures each comprise a recess and the front and rear engaging members each comprise a projection for engaging the recess.

26. The tap dance shoe of claim 23, wherein an adhesive resin is applied to the front screw and the rear screw before insertion into the nut mounted in the front fiber board and the rear fiber board, respectively.

27. The tap dance shoe of claim 23, wherein a spring is mounted on each of the front screw and the rear screw before insertion into the nut mounted in the front fiber board and the rear fiber board, respectively.

28. The tap dance shoe of claim 23, wherein a sound producing cavity is formed between each of the front tap and the sole of the shoe and the rear tap and the sole of the shoe.

29. The tap dance show of claim 23, wherein the front tap and the rear tap are attached to the shoe by only the front screw and the rear screw, respectively.

30. The tap dance shoe of claim 23, wherein the front tap and the rear tap are attached to the sole so as to be moveable toward and away from the sole of the shoe in any direction.

* * * * *